United States Patent [19]

Young

[11] 4,269,348

[45] May 26, 1981

[54] TRIANGULAR CARRYING CONTAINER

[75] Inventor: Harry E. Young, Houston, Tex.

[73] Assignee: Container Corporation of America, Chicago, Ill.

[21] Appl. No.: 89,046

[22] Filed: Oct. 29, 1979

[51] Int. Cl.[3] ..... B65D 5/46; B65D 25/22

[52] U.S. Cl. ..... 229/52 B; 229/22; 229/39 R

[58] Field of Search ..... 229/22, 39 R, 52 B

[56] References Cited

U.S. PATENT DOCUMENTS

| | | | |
|---|---|---|---|
| 443,397 | 12/1890 | Mack | 229/22 |
| 3,096,012 | 7/1963 | Bryant et al. | 229/52 B |
| 3,185,378 | 5/1965 | Rosenburg, Jr. | 229/22 |
| 3,374,937 | 3/1968 | Wilson | 229/39 R |
| 3,730,418 | 5/1973 | Spencer | 229/22 X |

FOREIGN PATENT DOCUMENTS

| | | | |
|---|---|---|---|
| 717375 | 9/1965 | Canada | 229/22 |

*Primary Examiner*—Davis T. Moorhead
*Attorney, Agent, or Firm*—Richard W. Carpenter

[57] ABSTRACT

An integral handle, self-locking, carrying container formed of paperboard.

2 Claims, 4 Drawing Figures

TRIANGULAR CARRYING CONTAINER

SUMMARY OF THE INVENTION

This invention relates to an integral handle carrying container which has self-locking ends.

It is an object of this invention to provide, in a tubular container with a generally triangular cross-section, an end wall construction that includes overlapping end wall flaps having interlocking engagement with each other and with the side walls of the container.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

Figure 1:
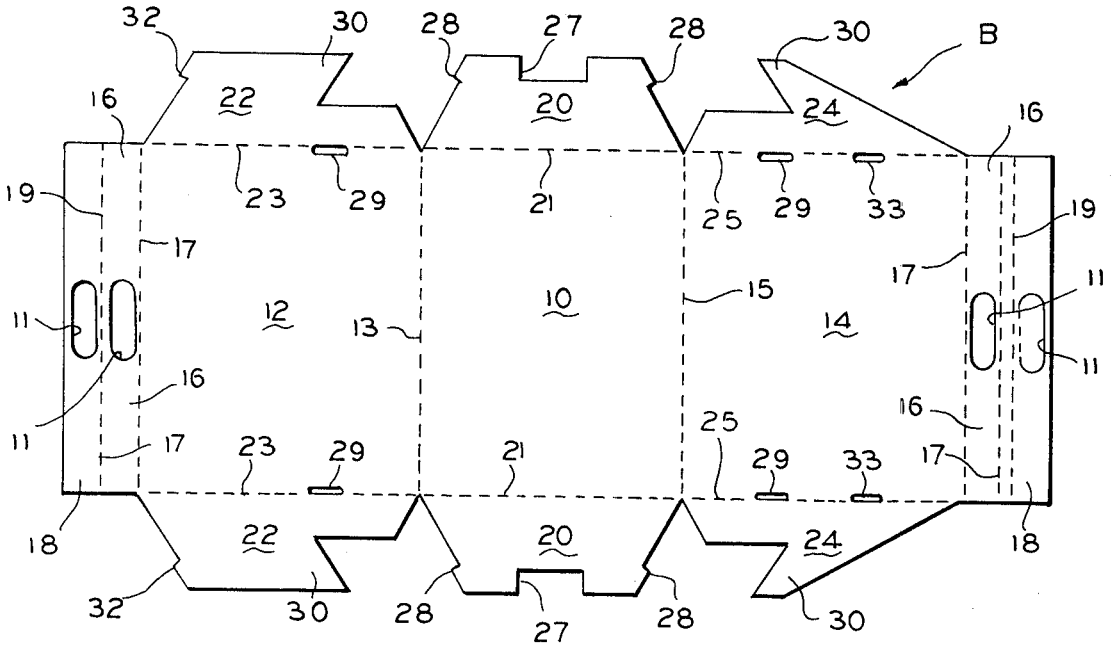
FIG. 1 is a plan view of a blank from which the container illustrated in the other views may be formed.
Figure 3:
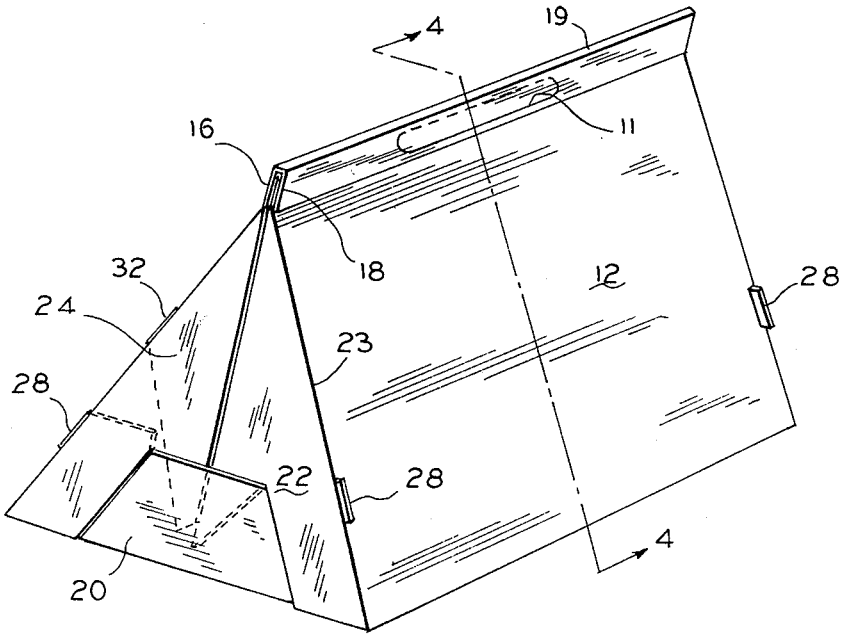
FIG. 3 is a perspective view of the container illustrated in FIG. 2, but shown in the fully erected condition.

Referring now to the drawings for a better understanding of the invention, and particularly to FIGS. 1 and 3, it will be seen that the invention relates to a generally triangular shaped carrying container, indicated generally at C, which may be formed from a unitary blank B of foldable sheet material such as paperboard. The container is an integral handle, self locking carrying container which does not require any outside securing means such as glue, staples, stitches, or tape.

Figure 2:
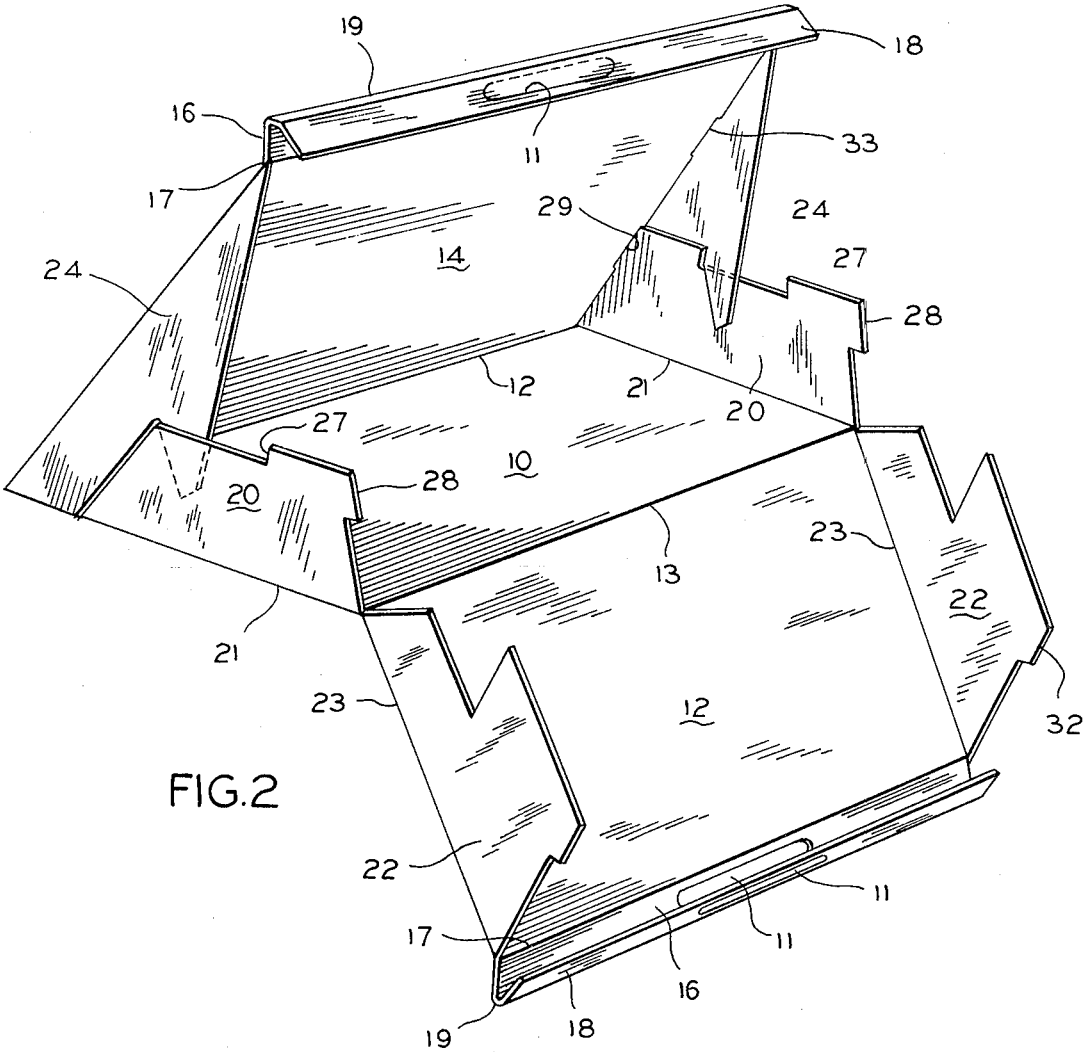
FIG. 2 is a perspective view of a container embodying features of the invention, as seen in the partially erected condition.

As best seen in FIGS. 1 and 2, container C includes a generally rectangular bottom wall 10 having a pair of first and second side walls 12 and 14 foldably joined at their lower edges along fold lines 13 and 15, respectively, to opposed side edges of bottom wall 10.

Side walls 12 and 14 are disposed to converge upwardly from the bottom wall to form therewith a generally tubular construction which is triangular in vertical cross section.

Figure 4:
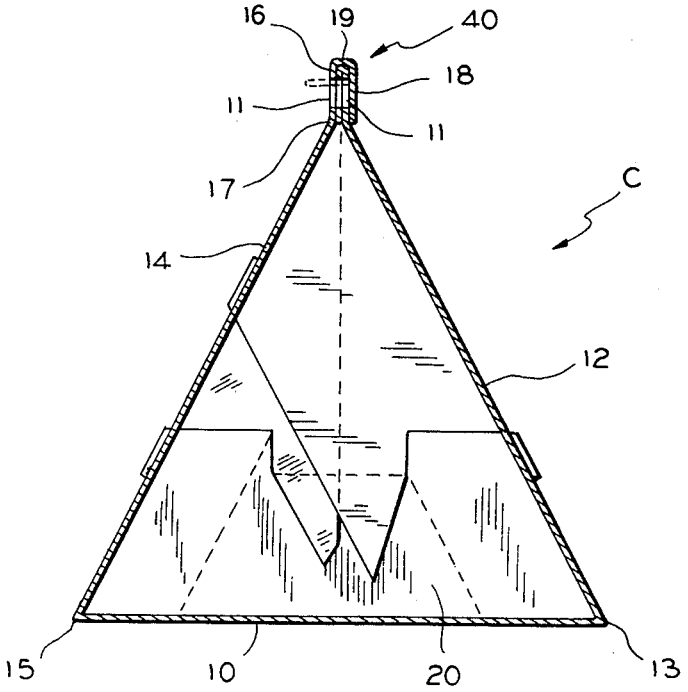
FIG. 4 is a transverse vertical section taken on line 4—4 of FIG. 3.

The upper ends of side walls are joined together by an integral handle indicated generally at 40. The handle 40 is formed from pairs of handle sections joined to each side wall and folded together in overlapped interlocking relation. Foldably joined along fold line 17 to the upper edge of each side wall is a first handle section 16 which in turn has a second handle section 18 foldably joined to the other edge along fold line 19. Each of the handle sections extending from each side wall is provided with hand hole 11, so that when the handle sections of the two side walls are folded together, as best seen in FIG. 4, all of the hand holes 11 are aligned with each other to form a common opening for grasping the handle of the container.

The primary novelty of the container resides in the end wall construction which includes an overlapping, interlocking construction eliminating the need for outside securing means. The end wall construction at each end of the container includes a center end wall 20 foldably joined at its lower edge along fold line 21 to an adjacent end edge of bottom wall 10, and a pair of first and second side end walls 22 and 24 which are foldably joined at their side edges along fold lines 23 and 25 to the adjacent end edges of first and second side walls 12 and 14.

Center end wall 20 is provided in its upper edge with a recess 27 and with a pair of lock tabs 28 formed along the sides thereof which are received within related openings 29 in the side walls of the container.

Each of the side end walls includes a generally rectangular wing or projection 30, and first side end walls 22 have projecting therefrom lock tabs 32 which are adapted to be received within related openings 33 in second side wall 14.

To assemble the container the side walls are folded upwardly from the bottom wall. The center and side end walls are then folded inwardly at right angles to the center and side walls and positioned in overlapping relationship, as best seen in FIGS. 2 and 3, with the lower portions of the side end walls being disposed outboardly of the center end wall, and with the projections 30 of the side end walls being received within the recesses 27 of the center end walls and tucked behind or inboardly of the center end walls to provide an overlapping, interlocking relationship between the center and side end walls.

At the same time the lock tabs 28 of the center end walls are received within the related recesses 29 of the adjacent side walls and lock tabs 32 of the first side end walls are received within the related recesses 33 of the second side wall 14. Thus the end wall construction is entirely self contained and interlocking.

At this point the handle construction is assembled by folding the handle sections 16 and 18 of one side wall in face to face relation with each other and interposing them between the related handle sections 16 and 18 of the other side wall in a sandwiched relationship as best seen in FIG. 4.

I claim:

1. An integral handle, self-locking, carrying container requiring no additional fastening means and being formed from a unitary blank of foldable paperboard or the like, comprising:

(a) a bottom wall;

(b) a pair of upwardly converging first and second side walls having their lower edges foldably joined to opposed side edges of said bottom wall, and forming with said bottom wall a tubular construction which is generally triangular in cross-section;

(c) said side walls having foldably joined to their upper edges integral handle sections adapted to be folded together in interlocking relation;

(d) opposed pairs of center, first side, and second side end walls foldably joined at their side edges to adjacent end edges of related bottom and side walls;

(e) said center and side end walls being disposed in overlapping relation with each other and in interlocking relation with each other and with said side walls; and (f) said side end walls having projections received within openings in said center end walls, and said side end walls having portions located outboardly of said center end walls and having other portions located inboardly of said center end walls.

2. A container according to claim 1, wherein certain of said center and end side walls have lock tabs projecting therefrom which are received within complementary openings in said side walls.

* * * * *